US011715933B2

(12) United States Patent
Ban et al.

(10) Patent No.: US 11,715,933 B2
(45) Date of Patent: Aug. 1, 2023

(54) SPARK PLUG

(71) Applicant: NGK SPARK PLUG CO., LTD., Nagoya (JP)

(72) Inventors: Kenji Ban, Nagoya (JP); Tatsuya Gozawa, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 135 days.

(21) Appl. No.: 17/425,522

(22) PCT Filed: Nov. 19, 2020

(86) PCT No.: PCT/JP2020/043147
§ 371 (c)(1),
(2) Date: Jul. 23, 2021

(87) PCT Pub. No.: WO2021/140756
PCT Pub. Date: Jul. 15, 2021

(65) Prior Publication Data

US 2022/0360051 A1 Nov. 10, 2022

(30) Foreign Application Priority Data

Jan. 10, 2020 (JP) ..... 2020-002593

(51) Int. Cl.
*H01T 13/32* (2006.01)
*H01T 13/08* (2006.01)
*H01T 13/34* (2006.01)

(52) U.S. Cl.
CPC ..... *H01T 13/08* (2013.01); *H01T 13/32* (2013.01); *H01T 13/34* (2013.01)

(58) Field of Classification Search
CPC ..... H01T 13/08; H01T 13/32; H01T 13/34
(Continued)

(56) References Cited

U.S. PATENT DOCUMENTS

2006/0276097 A1* 12/2006 Suzuki ..... H01T 13/20 445/7
2011/0148274 A1* 6/2011 Ernst ..... H01T 13/467 313/141

(Continued)

FOREIGN PATENT DOCUMENTS

EP 3214706 A1 * 9/2017 ..... H01T 13/16
JP 51-66945 A 6/1976

(Continued)

OTHER PUBLICATIONS

International Search Report from corresponding International Patent Application No. PCT/JP20/43147, dated Dec. 28, 2020.

*Primary Examiner* — Christopher M Raabe
(74) *Attorney, Agent, or Firm* — Kusner & Jaffe

(57) ABSTRACT

A spark plug includes a center electrode, a tubular metallic shell which holds the center electrode therein in an insulated state, and a ground electrode which faces a forward end portion of the center electrode. The metallic shell has a penetration hole which penetrates the metallic shell in a direction intersecting an axial direction. The ground electrode has a press-fitted portion inserted into the penetration hole and fixed to the metallic shell, a projecting portion projecting toward an inner side of the metallic shell, and an insertion portion disposed between the press-fitted portion and the projecting portion, inserted into the penetration hole, and forming a space between the insertion portion and an inner surface of the penetration hole. An angle $\alpha$ formed between the inner surface of the penetration hole and an outer surface of the insertion portion falls within a range of $0° < \alpha < 90°$.

6 Claims, 10 Drawing Sheets

(58) Field of Classification Search
USPC ..... 313/118
See application file for complete search history.

(56) References Cited

U.S. PATENT DOCUMENTS

| | | | | |
|---|---|---|---|---|
| 2018/0375300 | A1 | 12/2018 | Hasegawa et al. | |
| 2020/0006925 | A1* | 1/2020 | Shigenaga | H01T 13/32 |
| 2020/0358260 | A1* | 11/2020 | Gozawa | H01T 13/20 |
| 2021/0399532 | A1* | 12/2021 | Ban | H01T 13/54 |
| 2022/0094141 | A1* | 3/2022 | Saito | H01T 13/32 |
| 2023/0062977 | A1* | 3/2023 | Mishima | H01T 13/20 |

FOREIGN PATENT DOCUMENTS

| | | | |
|---|---|---|---|
| JP | 2017-111982 | A | 6/2017 |
| JP | 2019-46660 | A | 3/2019 |

* cited by examiner

SPARK PLUG

FIELD OF THE INVENTION

The present disclosure relates to a spark plug.

BACKGROUND OF THE INVENTION

A known spark plug is disclosed in, for example, Japanese Patent Application Laid-Open (kokai) No. 2019-46660. This spark plug includes a center electrode, a tubular metallic shell, an insulator for insulating the center electrode and the tubular metallic shell from each other, and a ground electrode tip which faces a forward end portion of the center electrode and has an approximately circular columnar shape. The metallic shell has a hole formed therein. The ground electrode tip is press-fitted into the hole of the tubular metallic shell and projects toward the inner side of the metallic shell.

In the case of the configuration in which the ground electrode tip is press-fitted into the hole of the tubular metallic shell in such a manner that the ground electrode tip projects toward the inner side of the metallic shell, there is concern that, due to vibration of a vehicle, a crack is generated in a region where the edge of the hole of the metallic shell is in contact with the outer surface of the ground electrode tip.

SUMMARY OF THE INVENTION

A spark plug of the present disclosure comprises a center electrode; a tubular metallic member which holds the center electrode therein in an insulated state; and a ground electrode which faces a forward end portion of the center electrode, wherein the metallic member has a penetration hole which penetrates the metallic member in a direction intersecting an axial direction; the ground electrode has a fixing portion inserted into the penetration hole and fixed to the metallic member, a projecting portion projecting toward an inner side of the metallic member, and an insertion portion disposed between the fixing portion and the projecting portion, inserted into the penetration hole, and forming a space between the insertion portion and an inner surface of the penetration hole; and an angle $\alpha$ formed between the inner surface of the penetration hole and an outer surface of the insertion portion falls within a range of $0° < \alpha < 90°$.

According to the present disclosure, it is possible to prevent generation of a crack, which would otherwise occur as a result of the edge of the penetration hole of the metallic member coming into contact with the outer surface of the ground electrode.

DETAILED DESCRIPTION OF THE INVENTION

Figure 1:
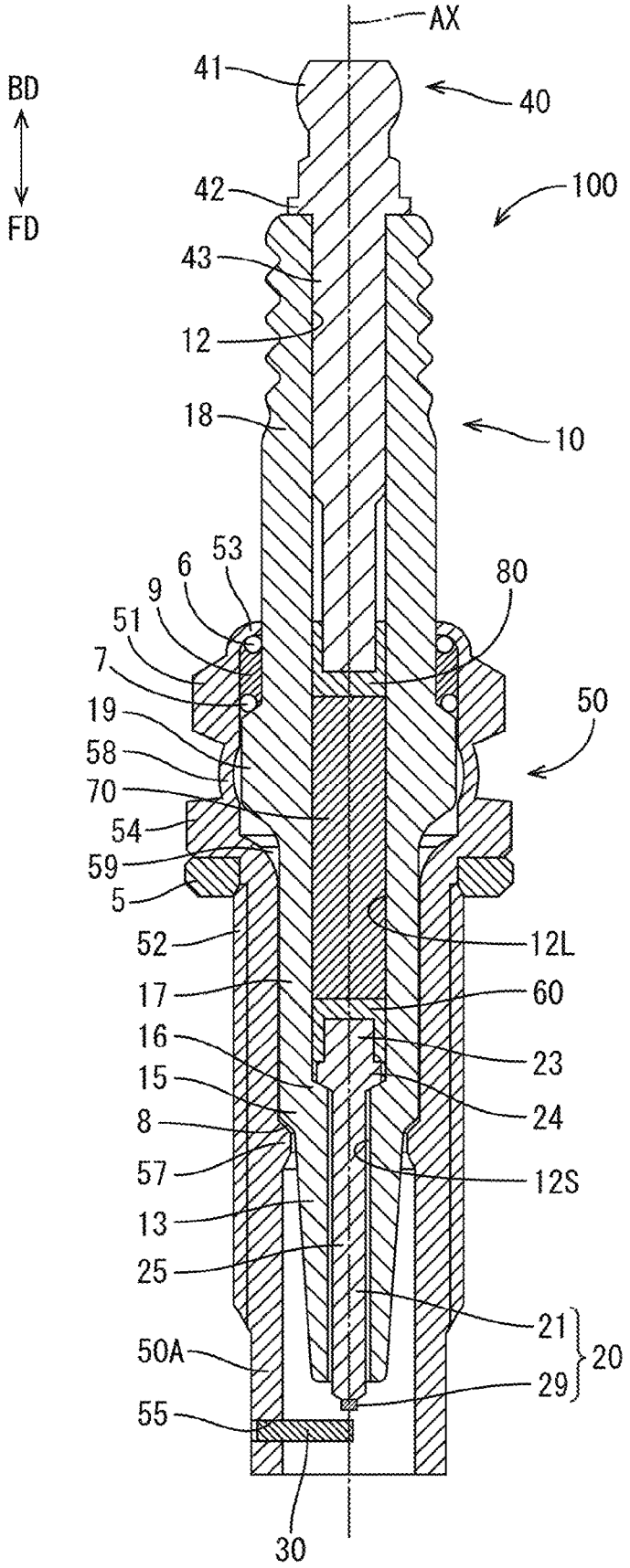
FIG. 1 is a sectional view of a spark plug of a first embodiment.

First, modes of the present disclosure will be listed and described.

(1) The spark plug of the present disclosure comprises a center electrode; a tubular metallic member which holds the center electrode therein in an insulated state; and a ground electrode which faces a forward end portion of the center electrode, wherein the metallic member has a penetration hole which penetrates the metallic member in a direction intersecting an axial direction; the ground electrode has a fixing portion inserted into the penetration hole and fixed to the metallic member, a projecting portion projecting toward an inner side of the metallic member, and an insertion portion disposed between the fixing portion and the projecting portion, inserted into the penetration hole, and forming a space between the insertion portion and an inner surface of the penetration hole; and an angle $\alpha$ formed between the inner surface of the penetration hole and an outer surface of the insertion portion falls within a range of $0° < \alpha < 90°$.

According to the present configuration, since the angle $\alpha$ formed between the inner surface of the penetration hole of the metallic member and the outer surface of the insertion portion of the ground electrode is greater than 0° and less than 90°; i.e., $0° < \alpha < 90°$, even in the case where, for example, vibration of a vehicle occurs, it is possible to prevent the edge of the penetration hole of the metallic member from coming into contact with the outer surface of the ground electrode. Therefore, it is possible to prevent generation of a crack, which would otherwise occur as a result of the edge of the penetration hole of the metallic member coming into contact with the outer surface of the ground electrode.

(2) The inner surface of the penetration hole which forms the space between the inner surface of the penetration hole and the insertion portion is a sloping surface of a predetermined angle.

When this configuration is employed, formation of the inner surface of the penetration hole can be easily performed.

(3) The inner surface of the penetration hole which forms the space between the inner surface of the penetration hole and the insertion portion is a curved surface.

When this configuration is employed, a boundary portion between the inner surface of a portion of the penetration hole, into which portion the insertion portion is inserted, and the inner surface of a portion of the penetration hole, into which portion the fixing portion is press-fitted, can be made smooth. Therefore, it is possible to more reliably prevent generation of a crack, which would otherwise occur as a result of the edge of the penetration hole of the metallic member coming into contact with the outer surface of the ground electrode.

(4) The insertion portion has an outer diameter which is constant in a direction in which the insertion portion is inserted into the penetration hole.

When this configuration is employed, since the insertion portion has a constant outer diameter, formation of the ground electrode can be easily performed.

(5) The insertion portion is reduced in outer diameter toward the inner side of the metallic member.

When this configuration is employed, an operation of inserting the ground electrode into the penetration hole can be easily performed.

(6) The penetration hole has an inner diameter which is constant in the direction intersecting the axial direction.

When this configuration is employed, machining of the penetration hole can be easily performed.

Details of First Embodiment of Present Disclosure

A specific example of a spark plug of the present disclosure will now be described with reference to the drawings. Notably, the present disclosure is not limited to the example. The scope of the present disclosure is defined by the claims and is intended to include all modifications within the meanings and scopes equivalent to those of the claims.

<Overall Structure of Spark Plug>

Figure 2:
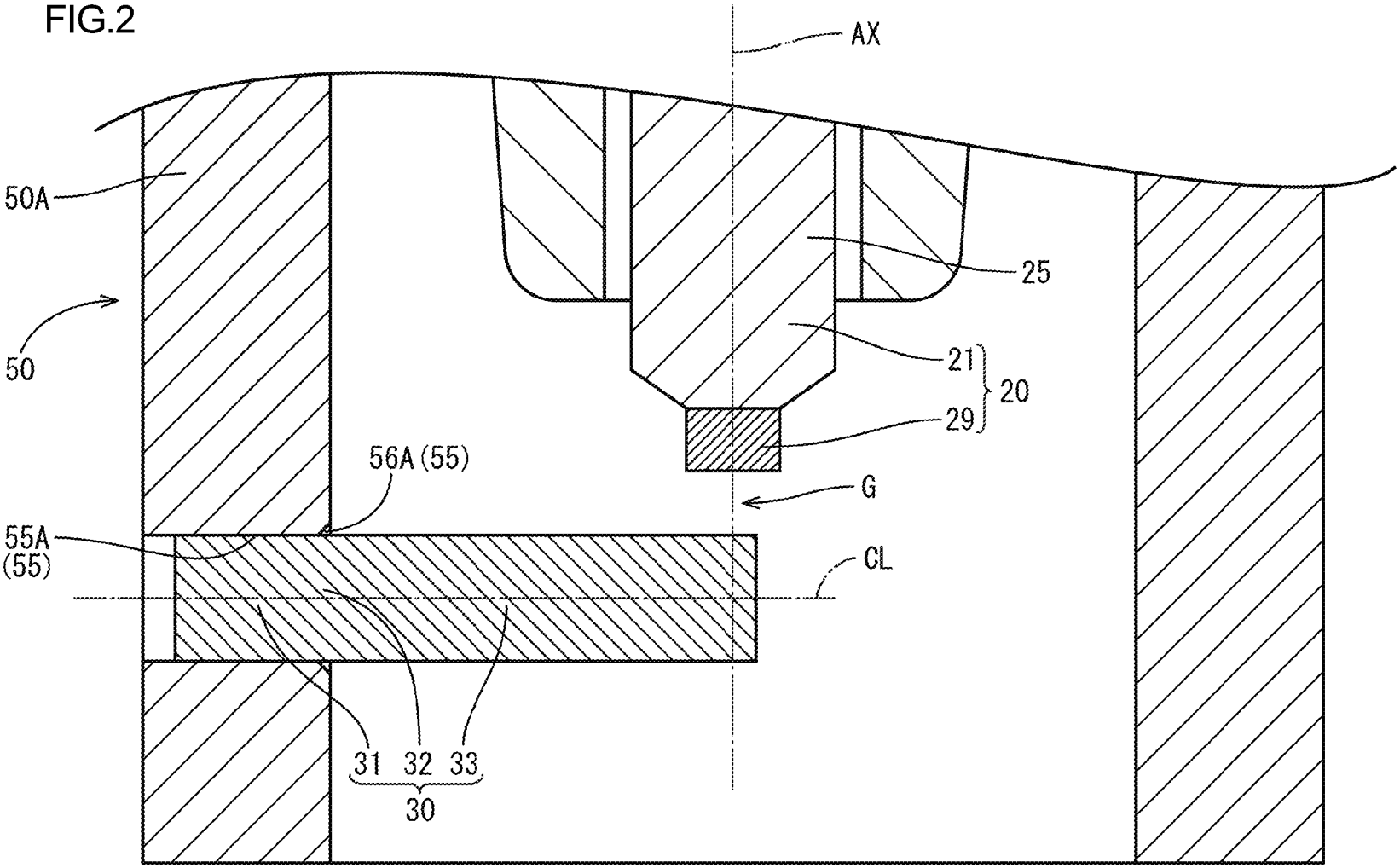
FIG. 2 is an enlarged sectional view of a forward end portion of the spark plug of FIG. 1.

FIG. 1 is a sectional view of a spark plug 100 of a first embodiment. FIG. 2 is an enlarged sectional view of a forward end portion of the spark plug 100 of FIG. 1. Alternate long and short dash lines in FIGS. 1 and 2 show the axis AX of the spark plug 100. The radial direction of a circle on a plane perpendicular to the axis AX will be referred to simply as the "radial direction," and the circumferential direction of the circle will be referred to simply as the "circumferential direction." The downward direction in FIG. 1 will be referred as the forward end direction FD, and the upward direction in FIG. 1 will be referred as the rear end direction BD. The lower side in FIGS. 1 and 2 will be referred to as the forward end side of the spark plug 100, and the upper side in FIGS. 1 and 2 will be referred to as the rear end side of the spark plug 100.

The spark plug 100 is mounted onto an internal combustion engine and is used for igniting an air-fuel mixture in a combustion chamber of the internal combustion engine. The spark plug 100 includes an insulator 10, a center electrode 20, a ground electrode 30, a metallic terminal member 40, a metallic shell 50, a resistor element 70, and electrically conductive seal members 60 and 80.

<Insulator>

The insulator 10 is an approximately cylindrical tubular member extending along the axis AX and having an axial hole 12 penetrating the insulator 10. The insulator 10 is formed by using, for example, a ceramic material such as alumina. The insulator 10 has a flange portion 19, a rear-end-side trunk portion 18, a forward-end-side trunk portion 17, an outer diameter reducing portion 15, and a leg portion 13.

The flange portion 19 is a portion of the insulator 10 located approximately at the center in the axial direction. The rear-end-side trunk portion 18 is located on the rear end side of the flange portion 19 and has an outer diameter smaller than that of the flange portion 19. The forward-end-side trunk portion 17 is located on the forward end side of the flange portion 19 and has an outer diameter smaller than that of the rear-end-side trunk portion 18. The leg portion 13 is located on the forward end side of the forward-end-side trunk portion 17 and has an outer diameter smaller than that of the forward-end-side trunk portion 17. The outer diameter of the leg portion 13 is reduced toward the forward end side. When the spark plug 100 is mounted onto an unillustrated internal combustion engine, the leg portion 13 is exposed to a combustion chamber of the internal combustion engine. The outer diameter reducing portion 15 is a portion formed between the leg portion 13 and the forward-end-side trunk portion 17 and decreasing in outer dimeter from the rear end side toward the forward end side.

On the inner circumferential side, the insulator 10 has a large inner diameter portion 12L located on the rear end side, a small inner diameter portion 12S located on the forward end side of the large inner diameter portion 12L and having an inner diameter smaller than that of the large inner diameter portion 12L, and an inner diameter reducing portion 16. The inner diameter reducing portion 16 is a portion formed between the large inner diameter portion 12L and the small inner diameter portion 12S and decreasing in inner dimeter from the rear end side toward the forward end side.

<Metallic Shell 50>

The metallic shell 50 has a cylindrical tubular shape as a whole and can be fixed to the engine head of the internal combustion engine. The metallic shell 50 is formed of an electrically conductive metallic material (for example, low carbon steel). The metallic shell 50 has a through hole 59 extending therethrough along the axis AX. The metallic shell 50 is disposed on the radially outer side of the insulator 10. Namely, the insulator 10 is inserted into and held in the through hole 59 of the metallic shell 50. The rear end of the insulator 10 projects from the rear end of the metallic shell 50 toward the rear end side.

The metallic shell 50 is provided to form a cylindrical tubular shape around the axis AX as a whole. The center electrode 20 is held inside the metallic shell 50 in an insulated state. The metallic shell 50 has a hexagonal columnar tool engagement portion 51, with which a tool such as a plug wrench is engaged, a mounting screw portion 52 for mounting the spark plug 100 onto the internal combustion engine, and a flange-like bearing portion 54 formed between the tool engagement portion 51 and the mounting screw portion 52. The nominal diameter of the mounting screw portion 52 is, for example, M8 to M18.

An annular metal gasket 5 is interposed between the mounting screw portion 52 and the bearing portion 54 of the metallic shell 50. When the spark plug 100 is mounted onto the internal combustion engine, the gasket 5 seals the gap between the spark plug 100 and the engine head of the internal combustion engine.

The metallic shell 50 further has a thin-walled crimp portion 53 provided on the rear end side of the tool engagement portion 51, and a thin-walled compressively deforming portion 58 provided between the bearing portion 54 and the tool engagement portion 51. Annular wire packings 6 and 7 are disposed in an annular region formed between an inner circumferential surface of a portion of the metallic shell 50 extending from the tool engagement portion 51 to the crimp portion 53 and an outer circumferential surface of the rear-end-side trunk portion 18 of the insulator 10. Powder of talc 9 is charged between the two wire packings 6 and 7 in that region. The rear end of the crimp portion 53 is bent toward the radially inner side and is fixed to the outer circumferential surface of the insulator 10. During manufacture, the compressively deforming portion 58 of the metallic shell 50 compressively deforms when the crimp portion 53 fixed to the outer circumferential surface of the insulator 10 is pressed toward the forward end side while being bent radially inward. As a result of the compressive deformation of the compressively deforming portion 58, via the wire packings 6 and 7 and the talc 9, the insulator 10 is pressed toward the forward end side within the metallic shell 50. The metallic shell 50 has a step portion 57 formed at a position on the inner circumferential side of the mounting screw portion 52. The outer diameter reducing portion 15 of the insulator 10 is pressed by the step portion 57 via an annular plate packing 8, whereby the plate packing 8 is held between the outer diameter reducing portion 15 and the step portion 57. Notably, the plate packing 8 may be omitted. As a result, the insulator 10 is fixed to the metallic shell 50 by the pressing force from the crimp portion 53 and the pressing force from the step portion 57. Also, the plate packing 8 prevents the air-fuel mixture within the combustion chamber of the internal combustion engine from leaking to the outside through the gap between the metallic shell 50 and the insulator 10. The metallic shell 50 has a cylindrical circumferential wall 50A which is provided on the forward end side thereof so as to surround the center electrode 20 and the leg portion 13 of the insulator 10.

<Center Electrode>

The center electrode 20 includes a rod-shaped center electrode body 21 extending along the axis AX, and an ignition portion 29. The center electrode body 21 is held in a forward-end-side portion of the axial hole 12 of the insulator 10. Namely, a rear-end-side portion of the center electrode 20 is disposed in the axial hole 12. The center electrode body 21 is formed of a metal having high corrosion resistance and high heat resistance, for example, nickel (Ni) or an alloy which contains nickel (Ni) in the largest amount (e.g., Ni alloy such as NCF600, NCF601, or the like). The center electrode body 21 may have a two-layer structure including a base material formed of Ni or an Ni alloy, and a core embedded in the base material. In this case, the core is formed of, for example, copper (Cu), which is higher in heat conductivity than the base material, or an alloy which contains copper (Cu) in the largest amount.

The center electrode body 21 has a flange portion 24 provided at a predetermined position in the axial direction, a head portion 23 which is a portion located on the rear end side of the flange portion 24, and a leg portion 25 which is a portion located on the forward end side of the flange portion 24. The flange portion 24 is supported from the forward end side by the inner diameter reducing portion 16 of the insulator 10. Namely, the center electrode body 21 is engaged with the inner diameter reducing portion 16. A forward-end-side portion of the leg portion 25; namely, a forward-end-side portion of the center electrode body 21, projects frontward from the forward end of the insulator 10. The ignition portion 29 is joined to the forward end of the center electrode body 21. The ignition portion 29 is formed of a noble metal having high melting point such as iridium (Ir) or platinum (Pt) or an alloy which contains the noble metal in the largest amount. Notably, it is possible to omit the ignition portion 29 and use the forward end of the center electrode body 21 as an ignition portion.

<Metallic Terminal Member>

The metallic terminal member 40 is a rod-shaped member extending in the axial direction. The metallic terminal member 40 is inserted into the axial hole 12 of the insulator 10 from the rear end side and is located on the rear end side of the center electrode 20 within the axial hole 12. The metallic terminal member 40 is formed of an electrically conductive metallic material (for example, low carbon steel), and the surface of the metallic terminal member 40 is plated with, for example, Ni for preventing corrosion.

The metallic terminal member 40 has a flange portion 42 formed at a predetermined position in the axial direction, an ignition coil connecting portion 41 located on the rear end side of the flange portion 42, and a leg portion 43 located on the forward end side of the flange portion 42. The ignition coil connecting portion 41 of the metallic terminal member 40 is exposed on the rear end side of the insulator 10. The leg portion 43 of the metallic terminal member 40 is inserted into the axial hole 12 of the insulator 10. An unillustrated ignition coil is electrically connected to the ignition coil connecting portion 41, whereby a high voltage for generating discharge is applied to the metallic terminal member 40.

<Resistor Element>

The resistor element 70 is disposed in the axial hole 12 of the insulator 10 to be located between the forward end of the metallic terminal member 40 and the rear end of the center electrode 20. The resistor element 70 has a resistance of, for example, 1 [kΩ] or larger (for example, 5 [kΩ]), and has a function of reducing radio noise generated as a result of generation of spark. The resistor element 70 is formed of, for example, a composition including glass particles (main component), ceramic particles other than the glass particles, and an electrically conductive material.

A gap is provided between the forward end of the resistor element 70 and a rear end portion of the center electrode 20 within the axial hole 12, and this gap is filled with an electrically conductive seal member 60. Meanwhile, another gap is provided between the rear end of the resistor element 70 and a forward end portion of the metallic terminal member 40 within the axial hole 12, and this gap is filled with an electrically conductive seal member 80. Namely, the seal member 60 is in contact with both the center electrode 20 and the resistor element 70 and provides a spacing between the center electrode 20 and the resistor element 70. The seal member 80 is in contact with both the resistor element 70 and the metallic terminal member 40 and provides a spacing between the resistor element 70 and the metallic terminal member 40. As described above, the seal members 60 and 80 establish electrical and physical connection between the center electrode 20 and the metallic terminal member 40 via the resistor element 70. The seal members 60 and 80 are formed of an electrically conductive material; for example, a composition containing particles of glass (for example, $B_2O_3$—$SiO_2$ glass) and particles of a metal (for example, Cu or Fe).

<Penetration Hole>

Figure 4:
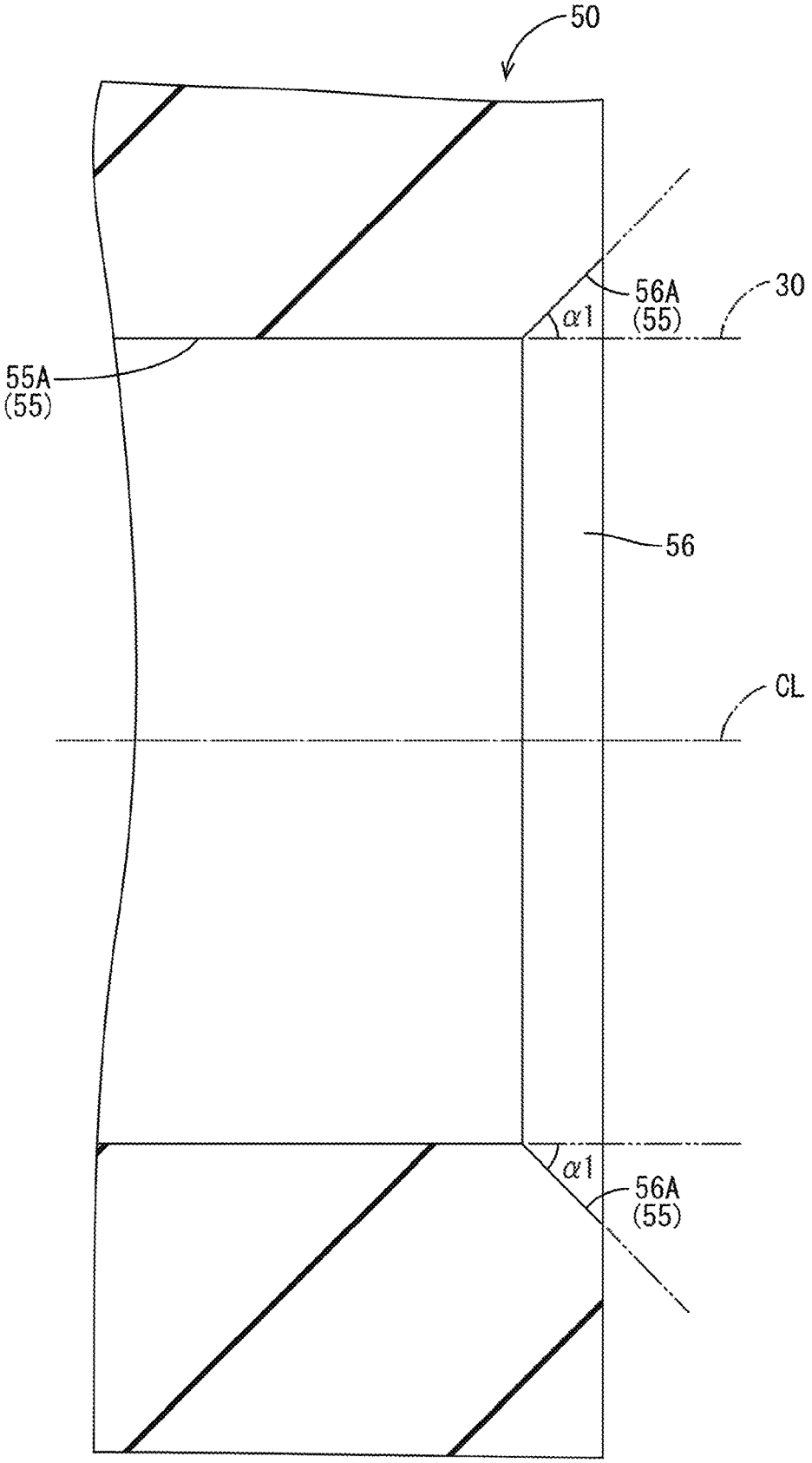
FIG. 4 is a sectional view showing, on an enlarged scale, a portion of a metallic shell in the vicinity of the penetration hole.
Figure 5:
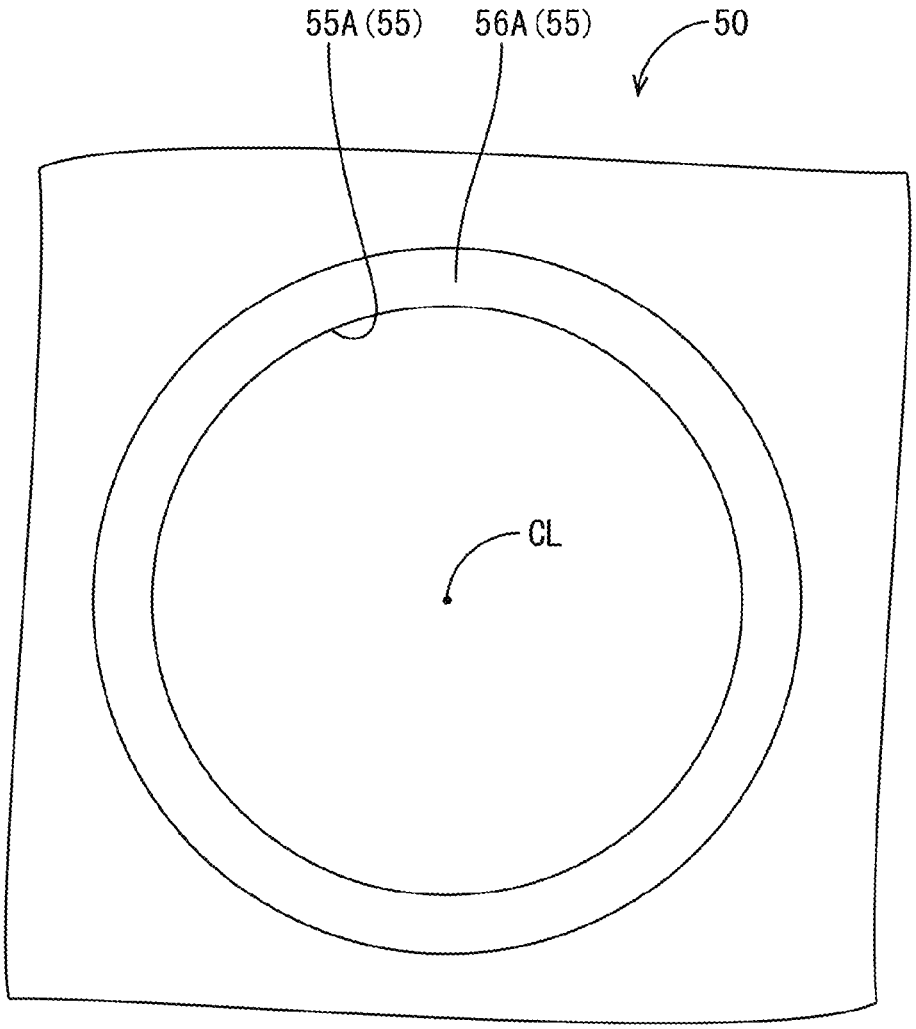
FIG. 5 is a view showing, on an enlarged scale, a portion of the circumferential wall of the metallic shell in the vicinity of the penetration hole, as viewed from the inner surface side of the circumferential wall.
Figure 6:
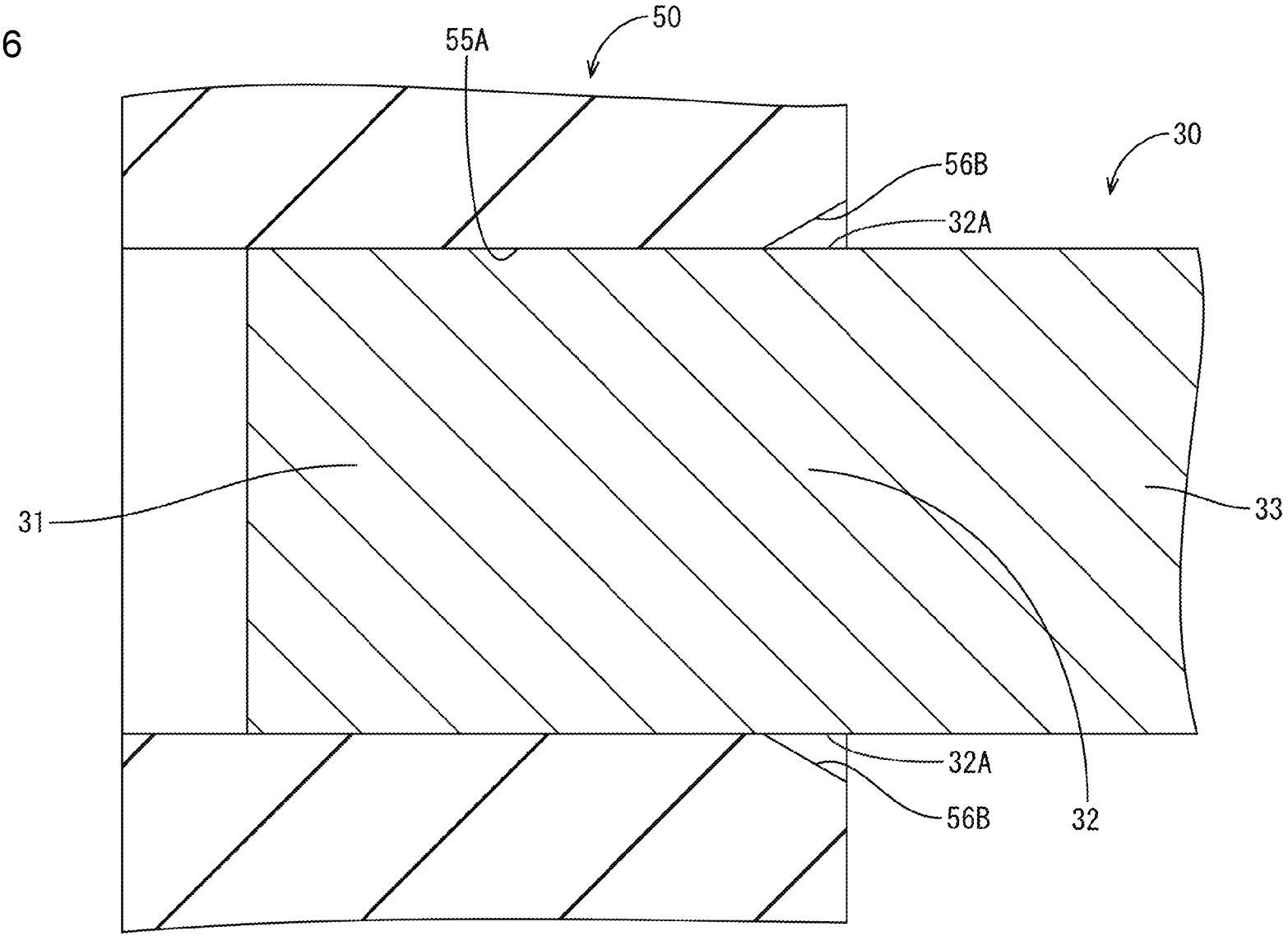
FIG. 6 is a sectional view showing a ground electrode press-fitted into a penetration hole having a different dimeter increasing portion.

As shown in FIG. 2, a penetration hole 55 is formed in the circumferential wall 50A on the forward end side of the metallic shell 50 in such a manner that the penetration hole 55 penetrates the circumferential wall 50A in the radial direction of the metallic shell 50. The ground electrode 30 is press-fitted into the penetration hole 55, thereby being fixed thereto. As shown in FIGS. 4 and 5, the penetration hole 55 is, for example, perfectly circular, and the inner circumferential surface of the penetration hole 55 has a constant diameter portion 55A having a constant diameter and a diameter increasing portion 56A which is disposed at an opening end on the side toward the center electrode 20 and whose diameter is increased over the entire circumference. The constant diameter portion 55A is provided over approximately the entire length of the penetration hole 55 in the direction of the axial line CL (the entire length excluding the diameter increasing portion 56A). The diameter of the diameter increasing portion 56A is increased from an end portion of the constant diameter portion 55A over the entire circumference, so that the diameter increasing portion 56A has a tapered shape. In the present embodiment, the angle $\alpha 1$ ($\alpha$) between the axial line CL of the penetration hole 55 and the inner surface of the diameter increasing portion 56A is set to 45°. Notably, the angle α1 is not limited thereto, and, as shown in FIG. 6, the penetration hole 55 may have a diameter increasing portion 56B formed in such a manner that the angle α1 between the inner surface of the diameter increasing portion 56B and an outer surface 32A of an insertion portion 32 becomes 30°. Namely, it is sufficient that the angle α1 falls within an angular range determined such that no edge is formed at least at the opening end of the inner surface of the penetration hole 55 and a space is formed between the opening end of the penetration hole 55 and the insertion portion 32 (0°<α1<90°).

<Ground Electrode>

The ground electrode 30 is composed of a ground electrode tip which has a perfectly circular columnar shape and which contains a noble metal. For example, the ground electrode tip is formed of a noble metal having high melting point such as iridium (Ir) or platinum (Pt) or an alloy which contains the noble metal in the largest amount. The ground electrode 30 is disposed at a position between the forward end of the metallic shell 50 and the forward end of the center electrode 20 as viewed in the direction of the axis AX.

Figure 3:
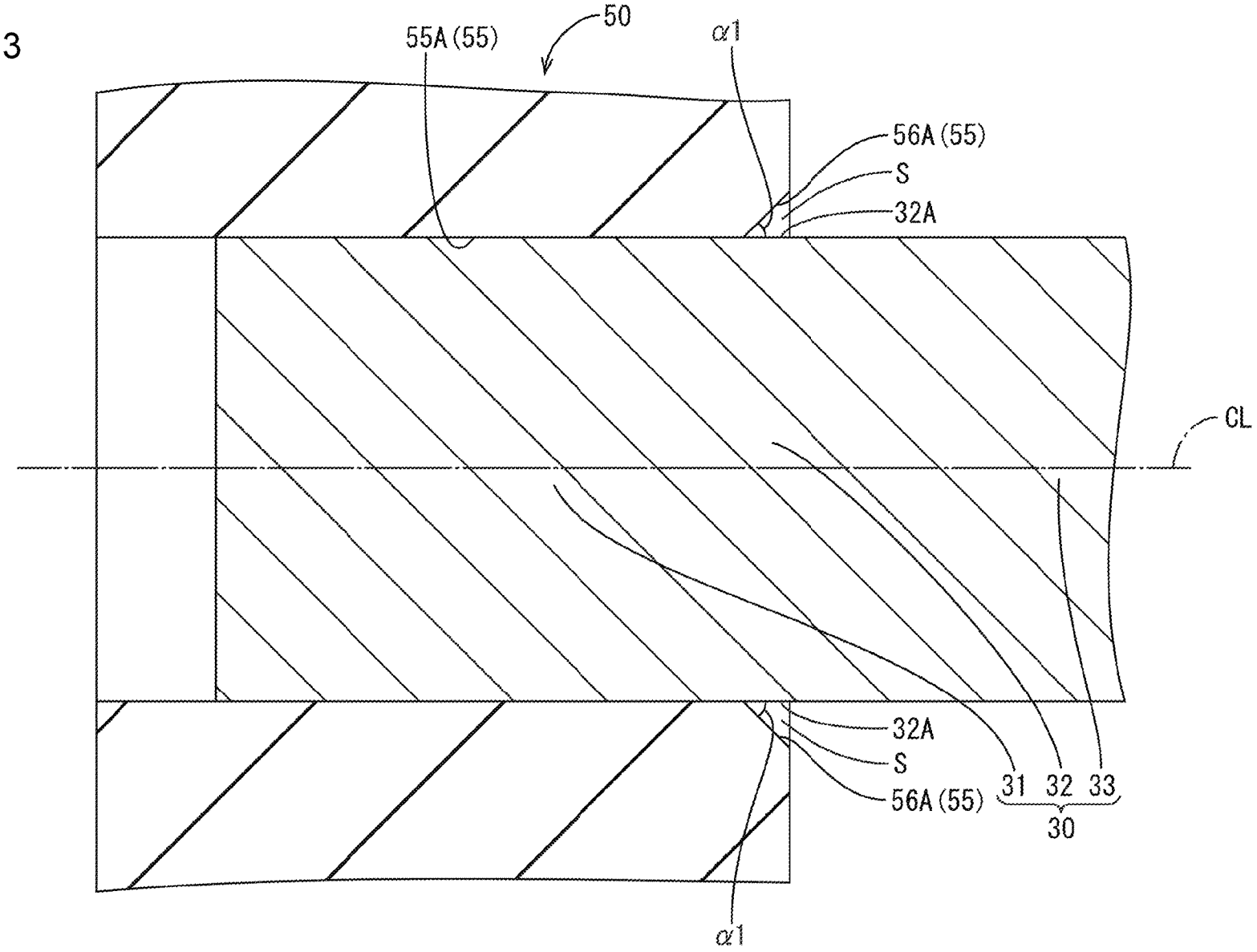
FIG. 3 is a sectional view showing a ground electrode press-fitted into a penetration hole.

As shown in FIG. 3, the ground electrode 30 has a press-fitted portion 31 press-fitted into the penetration hole 55, a projecting portion 33 projecting toward the inner side of the metallic shell 50, and the insertion portion 32 disposed between the press-fitted portion 31 and the projecting portion 33. The insertion portion 32 is inserted into the penetration hole 55 and forms a space between the insertion portion 32 and the inner surface of the penetration hole 55. The press-fitted portion 31 is inserted into the penetration hole 55 and is in contact with the inner circumferential surface of the penetration hole 55, with no space formed therebetween, over the entire circumference and over the entire length in the axial direction of the ground electrode 30. The press-fitted portion 31 corresponds to the "fixing portion" in the claims.

As shown in FIG. 2, the projecting portion 33 is disposed inside the circumferential wall 50A of the metallic shell 50, and a distal end portion of the projecting portion 33 faces a forward end portion of the center electrode 20. A gap G is formed between the center electrode 20 and an inner surface of the projecting portion 33. The gap G is a so-called spark gap at which discharge is generated.

As shown in FIG. 3, the insertion portion 32 is disposed in the diameter increasing portion 56A of the penetration hole 55. The angle between the outer surface 32A of the insertion portion 32 and the inner surface of the diameter increasing portion 56A is set to α1 (0°<α1<90°), whereby a space S is formed between the insertion portion 32 and the diameter increasing portion 56A.

Action and Effect of First Embodiment

In the above-described spark plug 100 of the present embodiment, since the angle α1 between the inner surface of the diameter increasing portion 56A of the penetration hole 55 of the metallic shell 50 and the outer surface of the insertion portion 32 of the ground electrode 30 falls within the range of 0° to 90° (0°<α1<90°), no edge is formed at the opening end of the penetration hole 55. Therefore, even in the case where, for example, engine vibration occurs, it is possible to prevent generation of a crack, which would otherwise occur as a result of the edge of the penetration hole 55 of the metallic shell 50 coming into contact with the outer surface of the ground electrode 30.

Details of Second Embodiment of Present Disclosure

Figure 7:
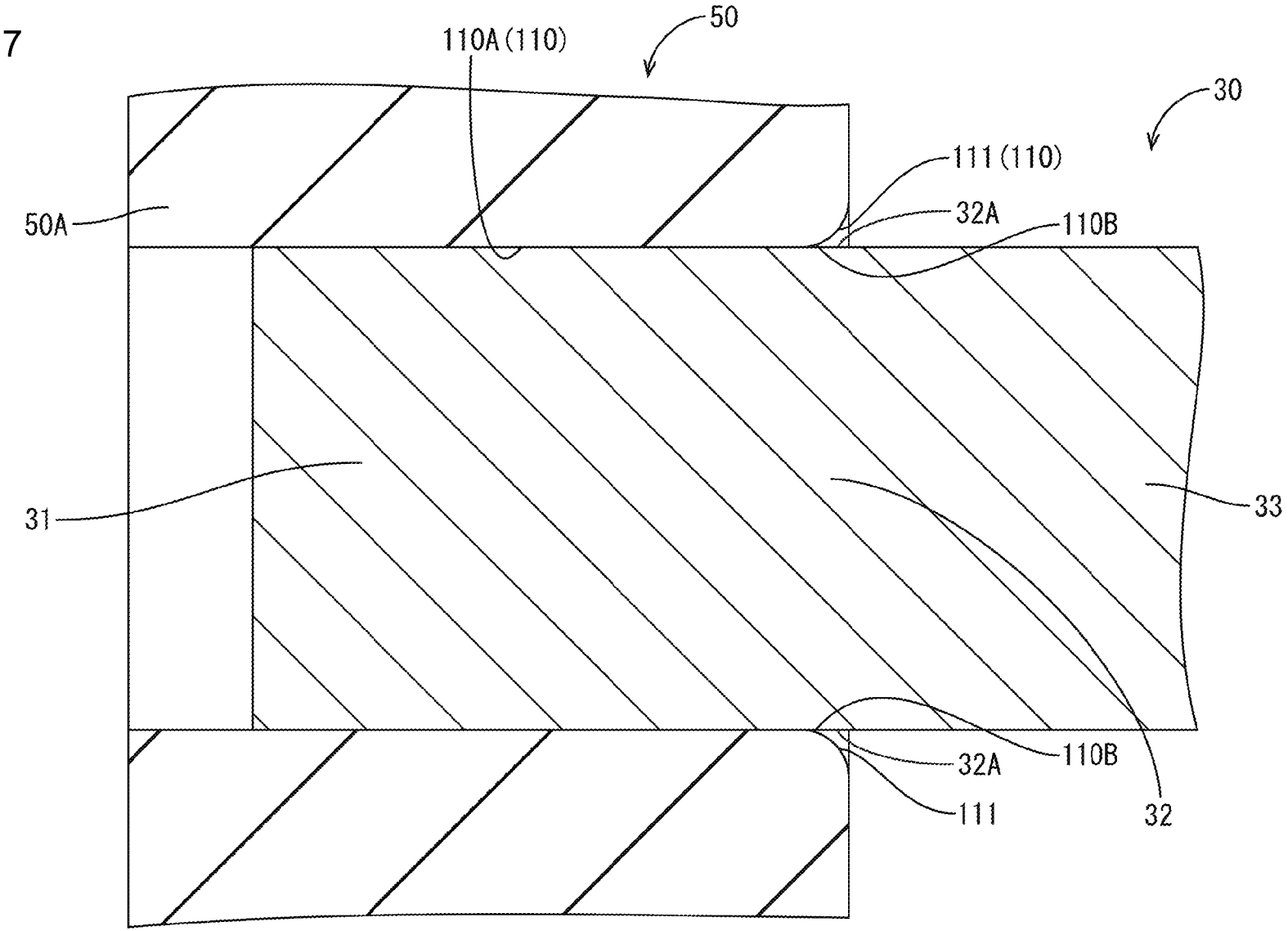
FIG. 7 is a sectional view showing a ground electrode press-fitted into a penetration hole of a second embodiment.

Next, a second embodiment in which the configuration of the diameter increasing portion 56A or 56B of the penetration hole 55 of the first embodiment is changed will be described with reference to FIG. 7. In the below, the same structural elements as those of the first embodiment are denoted by the same reference numerals, and their descriptions will not be repeated.

A diameter increasing portion 111 of a penetration hole 110 is provided in such a manner as to penetrate the circumferential wall 50A of the metallic shell 50 in the radial direction. The inner circumferential surface (inner surface) of the penetration hole 110 has a constant diameter portion 110A (inner circumferential surface) having a constant diameter, and a diameter increasing portion 111 which is located (at an opening end portion) on the side toward the center electrode 20 and whose diameter is increased over the entire circumference. The inner surface of the diameter increasing portion 111 is a curved surface, and the hole diameter of the diameter increasing portion 111 is increased toward the center electrode 20 side (the opening end side) in such a manner that the inner surface of the diameter increasing portion 111 has an arcuate shape. The radius R of curvature of the arcuate diameter increasing portion 111 may be set to, for example, 0.1 [mm]. Since the insertion portion 32 of the ground electrode 30 is disposed inside the diameter increasing portion 111, an angle larger than 0° and smaller than 90° is formed between the outer surface 32A of the insertion portion 32 and the inner surface of the diameter increasing portion 111.

According to the second embodiment, a boundary portion 110B between the inner surface of the diameter increasing portion 111 into which the insertion portion 32 is inserted and the inner surface 110A of a portion of the penetration hole 110 into which the press-fitted portion 31 is press-fitted can be made smooth. Therefore, it is possible to more reliably prevent generation of a crack, which would otherwise occur as a result of the edge of the penetration hole 110 of the metallic shell 50 coming into contact with the outer surface of the ground electrode 30.

Details of Third Embodiment of Present Disclosure

Next, a third embodiment in which the configuration of the ground electrode 30 used in the above-described embodiments is partially changed will be described with reference to FIGS. 8 to 10. In the below, the same structural elements as those of the above-described embodiments are denoted by the same reference numerals, and their descriptions will not be repeated.

Figure 8:
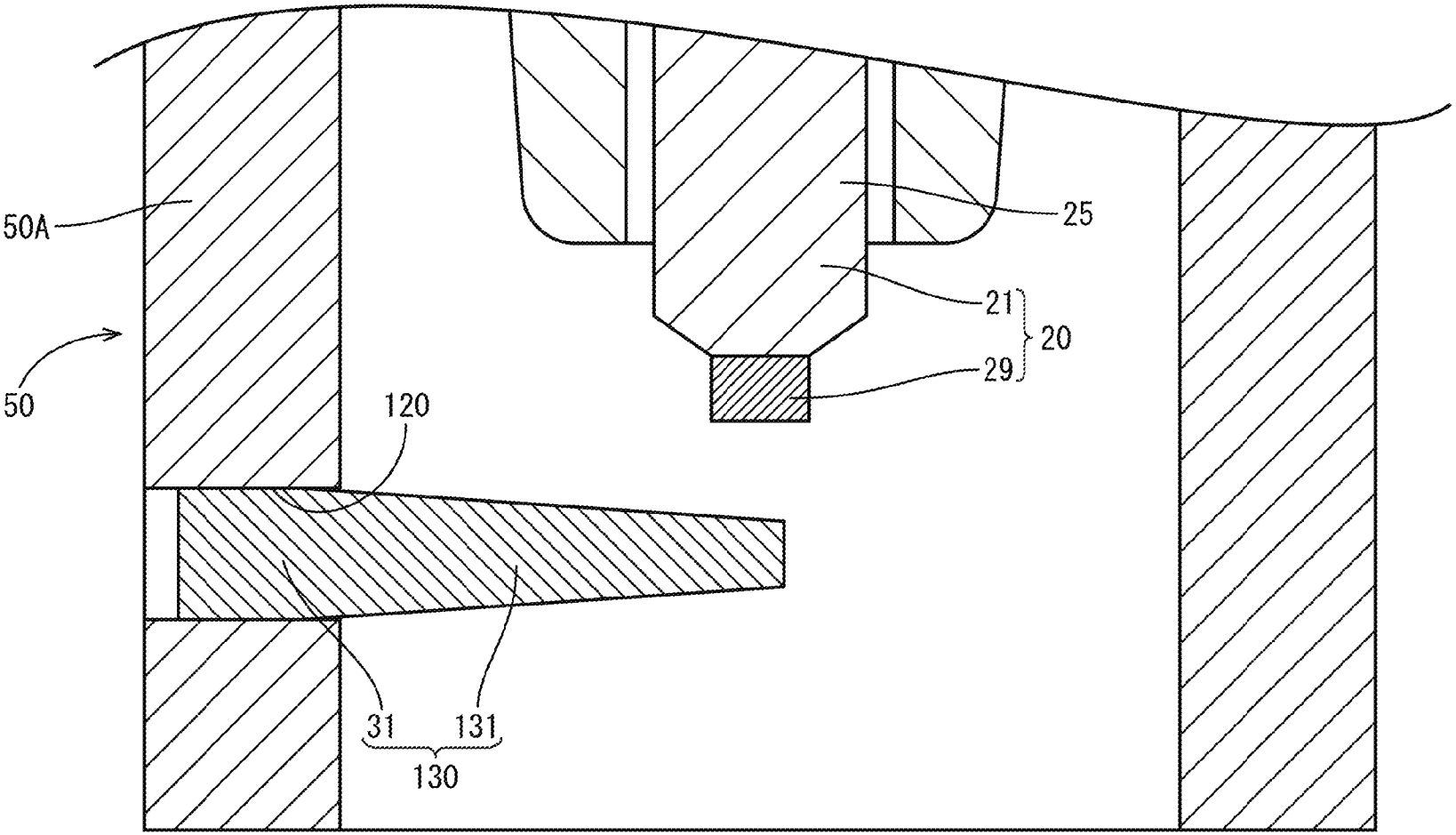
FIG. 8 is an enlarged sectional view of a forward end portion of a spark plug of a third embodiment.
Figure 9:
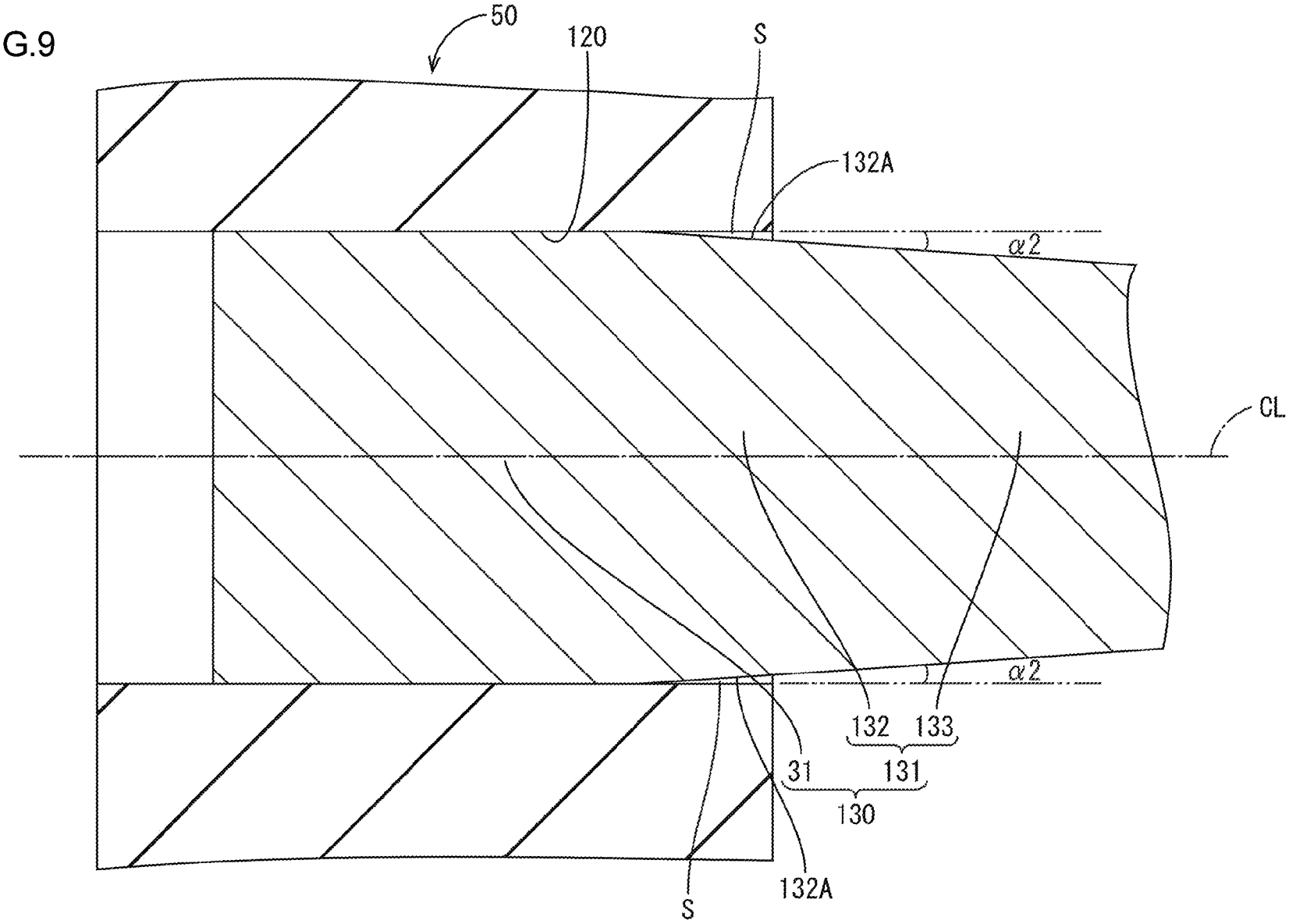
FIG. 9 is a sectional view showing a state in which a ground electrode of the third embodiment is press-fitted into a penetration hole.

As shown in FIG. 8, a penetration hole 120 extending in the radial direction is formed in the circumferential wall 50A of the metallic shell 50, and a ground electrode 130 is press-fitted into the penetration hole 120, thereby being fixed thereto. The penetration hole 120 is a perfectly circular hole having a constant inner diameter over the entire length in the axial direction of the penetration hole 120. The forward end of the metallic shell 50 is located forward of the forward end of the center electrode 20.

Figure 10:
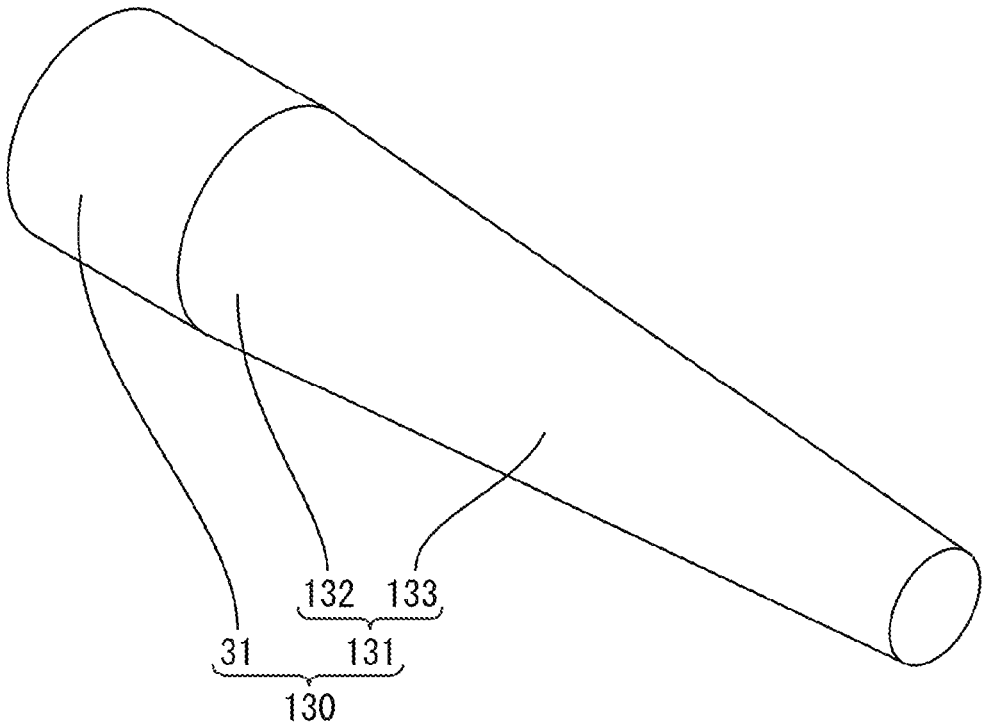
FIG. 10 is a perspective view showing the ground electrode of the third embodiment.

As shown in FIG. 10, the ground electrode 130 has a press-fitted portion 31 having a circular columnar shape and press-fitted into the penetration hole 120, and a conical small diameter portion 131 extending continuously from the press-fitted portion 31. As shown in FIG. 9, the press-fitted portion 31 is in contact with the inner circumferential surface of the penetration hole 120, with no space formed therebetween, over the entire circumference and over the entire length in the axial direction of the press-fitted portion 31.

The small diameter portion 131 has an insertion portion 132 inserted into the penetration hole 120, and a projecting portion 133 projecting toward the inner side of the metallic shell 50. The insertion portion 132 is disposed (at the opening end portion) on the center electrode 20 side within the penetration hole 120, and a space S is formed between the insertion portion 132 and the inner surface of the penetration hole 120. The outer circumferential surface 132A of the insertion portion 132 has a predetermined angle $\alpha 2(\alpha)$, over the entire circumference, in relation to a direction parallel to the axial line CL of the penetration hole 120. In the present embodiment, the angle $\alpha 2$ is set to 30°. The angle $\alpha 2$ is not limited thereto, and it is sufficient that the angle $\alpha 2$ is an angle $\alpha$ determined such that no edge is formed at least at the opening end of the inner surface of the penetration hole 120 and a space is formed between the opening end of the penetration hole 120 and the insertion portion 132 ($0° < \alpha < 90°$).

The projecting portion 133 is disposed inside the metallic shell 50 and faces the center electrode 20. A gap G is formed between the center electrode 20 and a distal end portion of the projecting portion 133. The gap G is a so-called spark gap at which discharge is generated.

According to the third embodiment, the insertion portion 132 is formed in such a manner that its outer diameter decreases toward the inner side of the metallic shell 50. Therefore, an operation of inserting the ground electrode 130 into the penetration hole 120 can be easily performed.

Other Embodiments (1) The entirety of each of the ground electrodes 30 and 130 is composed of a noble metal tip. However, this is not a limitation, and each of the ground electrodes 30 and 130 may be composed of, for example, a ground electrode body including at least the press-fitted portion 31, and a noble metal tip (ignition portion) joined to a distal end portion of the ground electrode body by means of welding such as laser welding. The ground electrode body is formed of a metal having high corrosion resistance and high heat resistance, for example, nickel (Ni) or an alloy which contains nickel (Ni) in the largest amount (e.g., Ni alloy such as NCF600, NCF601, or the like). The noble metal tip is formed of a noble metal having high melting point such as iridium (Ir) or platinum (Pt) or an alloy which contains the noble metal in the largest amount.

(2) The shapes of the penetration holes 55, 110, and 120 are perfectly circular. However, the shapes of the penetration holes 55, 110, and 120 are not limited thereto, and the penetration holes 55, 110, and 120 may have a polygonal shape or the shape of an ellipse having major and minor axes. Also, the ground electrode 30 has the shape of a circular column having a perfectly circular cross section. However, the shape of the ground electrode 30 is not limited thereto, and the ground electrode 30 may have the shape of a circular column whose cross section is not perfectly circular or the shape of a polygonal column.

(3) The axial lines CL of the penetration holes 55, 110, and 120 are orthogonal to the axis AX of the metallic shell 50 (and the center electrode 20). However, this is not a limitation, and the axial lines CL may intersect with the axis AX.

(4) The metallic shell 50 is open at its forward end. However, this is not a limitation, and the forward end of the metallic shell 50 may be covered with a cap.

(5) The side surface of the distal end portion of the projecting portion 33 faces the forward end surface of the center electrode 20. However, this is not a limitation, and a configuration in which the distal end surface of the projecting portion 33 faces the side surface of the center electrode 20 may be employed.

(6) The ground electrode 30 is fixed to the inner circumferential surface of the penetration hole 55 by means of press-fitting (the press-fitted portion 31). However, this is not a limitation, and a configuration in which the ground electrode is fixed to the inner circumferential surface of the penetration hole 55 by means of welding may be employed. In this case, the ground electrode 30 may be welded in such a manner that the ground electrode 30 is not in contact with the inner circumferential surface of the penetration hole 55 over the entire circumference and the ground electrode 30 is in contact with a portion of the inner circumferential surface of the penetration hole 55.

DESCRIPTION OF REFERENCE NUMERALS AND SYMBOLS

5: gasket 6, 7: wire packing 8: plate packing 9: talc 10: insulator 12: axial hole 12L: large inner diameter portion 12S: small inner diameter portion 13: leg portion 15: outer diameter reducing portion 16: inner diameter reducing portion 17: forward-end-side trunk portion 18: rear-end-side trunk portion 19: flange portion 20: center electrode 21: center electrode body 23: head portion 24: flange portion 25: leg portion 29: ignition portion 30, 130: ground electrode 31: press-fitted portion (fixing portion) 32, 132: insertion portion 32A: outer surface 33, 133: projecting portion 40: metallic terminal member 41: ignition coil connecting portion 42: flange portion 43: leg portion 50: metallic shell 50A: circumferential wall 51: tool engagement portion 52: mounting screw portion 53: crimp portion 54: bearing portion 55, 110, 120: penetration hole 55A, 110A: constant diameter portion 56A, 56B, 111: diameter increasing portion 110B: boundary portion 57: step portion 58: compressively deforming portion 59: through hole 60, 80: seal member 70: resistor element 100: spark plug 131: small diameter portion 132A: outer circumferential surface AX: axis BD: rear end direction CL: center axis FD: forward end direction G: gap R: radius of curvature S: space

What is claimed is:

1. A spark plug comprising:

a center electrode;

a tubular metallic member which holds the center electrode therein in an insulated state; and a ground electrode which faces a forward end portion of the center electrode, wherein the metallic member has a penetration hole which penetrates the metallic member in a direction intersecting an axial direction;

the ground electrode has a fixing portion inserted into the penetration hole and fixed to the metallic member, a projecting portion projecting toward an inner side of the metallic member, and an insertion portion disposed between the fixing portion and the projecting portion, inserted into the penetration hole, and forming a space between the insertion portion and an inner surface of the penetration hole; and an angle $\alpha$ formed between the inner surface of the penetration hole and an outer surface of the insertion portion falls within a range of $0° < \alpha < 90°$.

2. A spark plug according to claim 1, wherein the inner surface of the penetration hole which forms the space between the inner surface of the penetration hole and the insertion portion is a sloping surface of a predetermined angle.

3. A spark plug according to claim 1, wherein the inner surface of the penetration hole which forms the space between the inner surface of the penetration hole and the insertion portion is a curved surface.

4. A spark plug according to claim 1, wherein the insertion portion has an outer diameter which is constant in a direction in which the insertion portion is inserted into the penetration hole.

5. A spark plug according to claim 1, wherein the insertion portion is reduced in outer diameter toward the inner side of the metallic member.

6. A spark plug according to claim 5, wherein the penetration hole has an inner diameter which is constant in the direction intersecting the axial direction.

* * * * *